US009115506B2

(12) United States Patent
Hill

(10) Patent No.: US 9,115,506 B2
(45) Date of Patent: Aug. 25, 2015

(54) WOOD TO PIPE BRACKET AND A CONNECTION UTILIZING SUCH A BRACKET

(75) Inventor: Ian A. Hill, Plano, TX (US)

(73) Assignee: OZ-POST, INTERNATIONAL LLC, Richardson, TX (US)

( * ) Notice: Subject to any disclaimer, the term of this patent is extended or adjusted under 35 U.S.C. 154(b) by 148 days.

(21) Appl. No.: 13/585,406

(22) Filed: Aug. 14, 2012

(65) Prior Publication Data

US 2013/0043368 A1 Feb. 21, 2013

Related U.S. Application Data

(60) Provisional application No. 61/524,697, filed on Aug. 17, 2011.

(51) Int. Cl.
*E04H 17/14* (2006.01)

(52) U.S. Cl.
CPC .... *E04H 17/1421* (2013.01); *E04H 2017/1473* (2013.01)

(58) Field of Classification Search
CPC ..... E04H 2017/1473; E04H 17/1421; F16B 2/065; F16B 3/12; F16L 3/02; F16L 3/1016
USPC ..... 248/534, 62, 65, 74.1, 74.2, 229.15, 248/229.1, 230.6; 256/65.03; 40/607.12
See application file for complete search history.

(56) References Cited

U.S. PATENT DOCUMENTS

| | | | | |
|---|---|---|---|---|
| 558,391 | A * | 4/1896 | Israel | 248/74.4 |
| 4,955,574 | A * | 9/1990 | Freier | 248/316.5 |
| 4,958,792 | A * | 9/1990 | Rinderer | 248/74.2 |
| 5,297,890 | A | 3/1994 | Commins | |
| 5,344,112 | A * | 9/1994 | Peterson et al. | 248/313 |
| 2010/0288992 | A1 * | 11/2010 | Gray | 256/65.03 |

* cited by examiner

*Primary Examiner* — Joanne Silbermann
(74) *Attorney, Agent, or Firm* — Gardere Wynne Sewell LLP; Andre M. Szuwalski

(57) ABSTRACT

A bracket is formed from a front member and a back member. The front member includes a curvilinear portion flanked by first and second wing portions. The back member includes a central portion flanked by first and second end portions. The first and second wing portions of the curvilinear portion are secured by fasteners to the first and second wing portions, respectively, in a manner which forms a clamping area between the curvilinear portion and the central portion to frictionally attach the bracket to a received pipe/pole member. First and second upright members extend from the first and second wing portions, respectively. The first and second upright members support attachment of covering for boxing in of the received pipe/pole member and concealment of the bracket.

12 Claims, 9 Drawing Sheets

WOOD TO PIPE BRACKET AND A CONNECTION UTILIZING SUCH A BRACKET

PRIORITY CLAIM

This application claims priority to U.S. Provisional Application for Patent No. 61/524,697 filed Aug. 17, 2011, the disclosure of which is hereby incorporated by reference.

BACKGROUND OF THE INVENTION

1. Technical Field of the Invention

The present invention relates generally to a bracket for making a wood to pipe connection for example in connecting a wood fence structural member (such as a fence rail) to a post, pipe or pole member.

2. Description of Related Art

Reference is now made to FIGS. 1 and 2 which illustrate a perspective view of a prior art bracket and wood to pipe connection, respectively, as described in U.S. Pat. No. 5,297,890, the disclosure of which is hereby incorporated by reference. The bracket is used in making a wood to pipe connection for example in connecting a wood fence structural member (such as a fence rail) to a post, pipe or pole member.

The connection comprises: an elongated pipe (pole/post) member 2; a wood frame member 3 (such as a fence rail) disposed in close association to the elongated pipe member 2; a sheet metal connector 4 for attaching the wood frame member 3 and the elongated pipe member 2. The connector 4, forming the bracket, includes: a curvilinear portion 5 dimensioned for registering with and partially encircling the elongated pipe member 2 and having ends 6 and 7 spaced one from the other; first and second lug members 8 and 9, each integrally and respectively connected to the spaced ends 6 and 7 of the curvilinear member 5; foot members 10 and 11 respectively integrally connected to the first and second lug members 8 and 9 along bend lines 12 and 13; and cinching means 14 releasably attached to the first and second lug members 8 and 9 for drawing the lug members toward one another thereby decreasing the radius dimension of the curvilinear portion 5 and causing the curvilinear portion to frictionally engage the elongated pipe member 2; and fastener means 15 attaching the foot members 10 and 11 to the wood frame member 3.

The cinching means 14 is a bolt with a head 16 having a threaded distal end 17. The first lug member 8 is formed with an opening 20 dimensioned to receive the threaded bolt 14 therethrough and to prevent the head end 16 from passing therethrough. The second lug member 9 is formed with a threaded opening 21 dimensioned to threadably receive and engage the threaded distal end 17.

The foot members 10 and 11 are formed with openings 22 for receiving the fastener means 15 therethrough to engage the wood frame member 3.

The foot members 10 and 11 are prebent along bend lines 12 and 13 at angles 18 and 19 to the lug members 8 and 9; and the material at the bend lines 12 and 13 is selected to permit hand field bending of the foot members 10 and 11 with respect to the lug members 8 and 9. To facilitate hand field bending of foot members 10 and 11, bend lines 12 and 13 may be formed with a weakened cross section either by reducing the material at this point, scoring the bend lines or factory forming openings 23 along the bend lines 12 and 13.

In order to maintain first and second lug members 8 and 9 generally parallel while cinching means 14 is being tightened, indentations 24 may be formed in curvilinear portion 5 adjacent first and second lug members 8 and 9, and edge flanges 25 may be formed on both edges of the curvilinear portion 5 adjacent first and second lug members 8 and 9. Even more stiffening may be obtained by continuing edge flanges 25 into edge flanges 26 on both sides of first and second lug members 8 and 9.

SUMMARY

A wood to pipe bracket provides a connection mechanism between a wood member and pipe/pole/post member for use, for example, in a fencing application. The bracket comprises a front member and a back member. The front member comprises a curvilinear portion flanked by first and second wing portions. The back member comprises a central portion flanked by first and second end portions. The first and second wing portions of the curvilinear portion are secured by fasteners to the first and second wing portions, respectively, in a manner which forms a clamping area in a zone or region between the curvilinear portion and the central portion to frictionally attach the bracket to a received pipe/pole/post member.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 1:
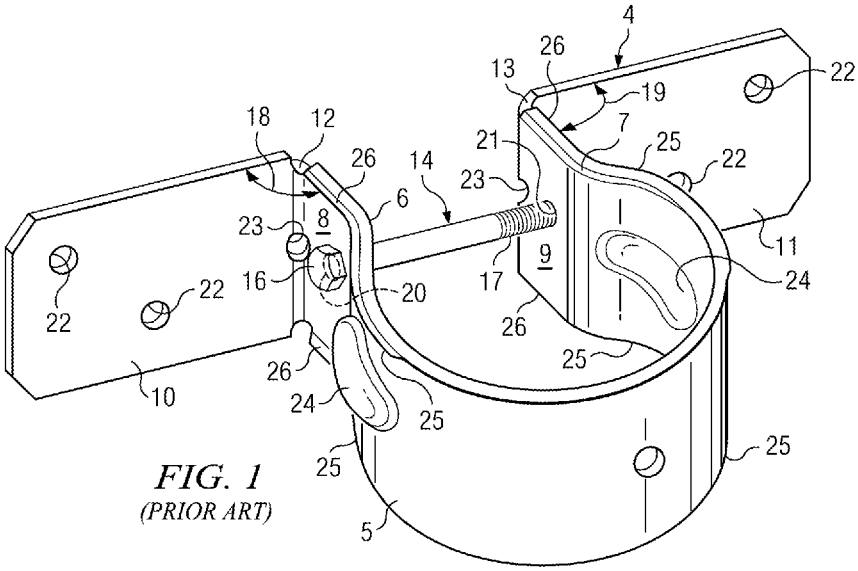
FIG. 1 (PRIOR ART)
FIG. 1 is a perspective view of a prior art bracket.
Figure 2:
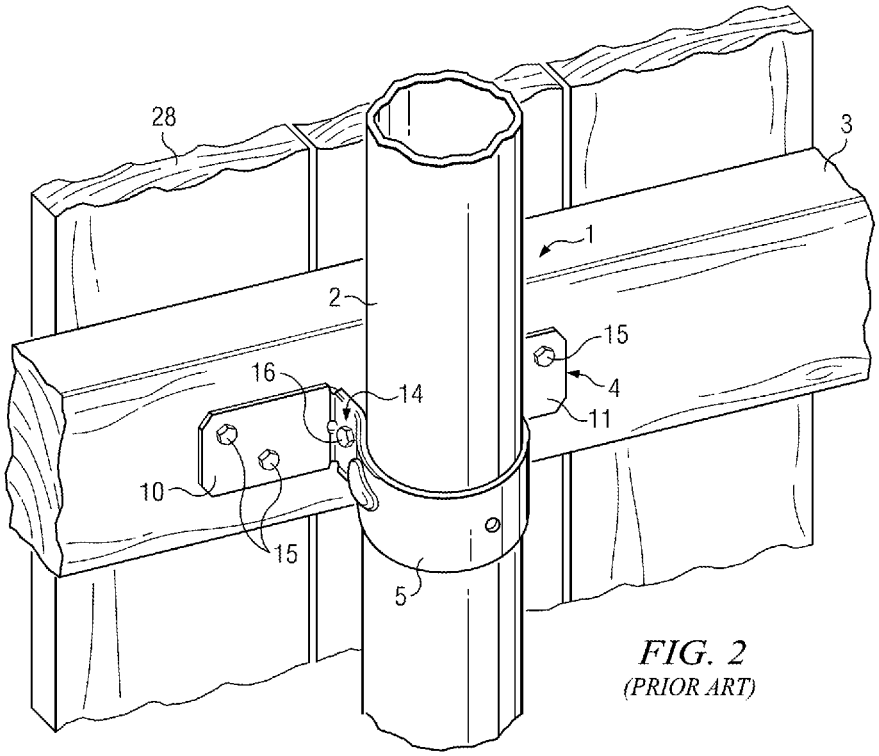
FIG. 2 (PRIOR ART)
FIG. 2 is a perspective view of a prior art wood to pipe connection using the bracket of FIG. 1.
Figure 3:
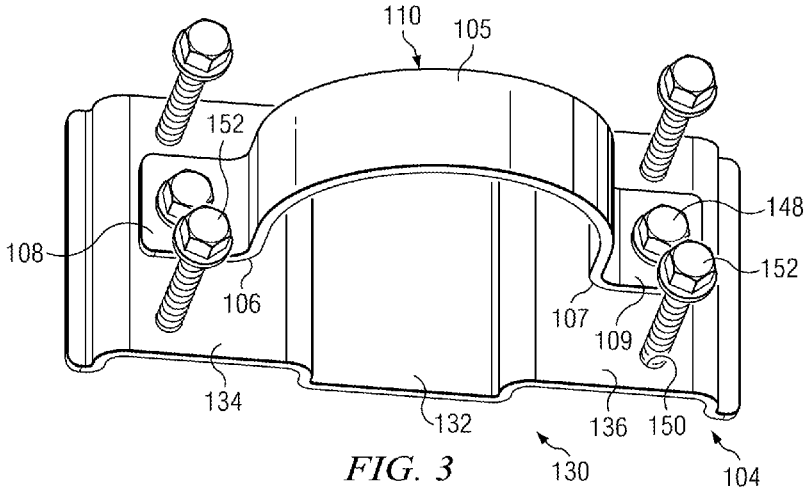
FIG. 3 illustrates a perspective view of an embodiment for a bracket.
Figure 4:
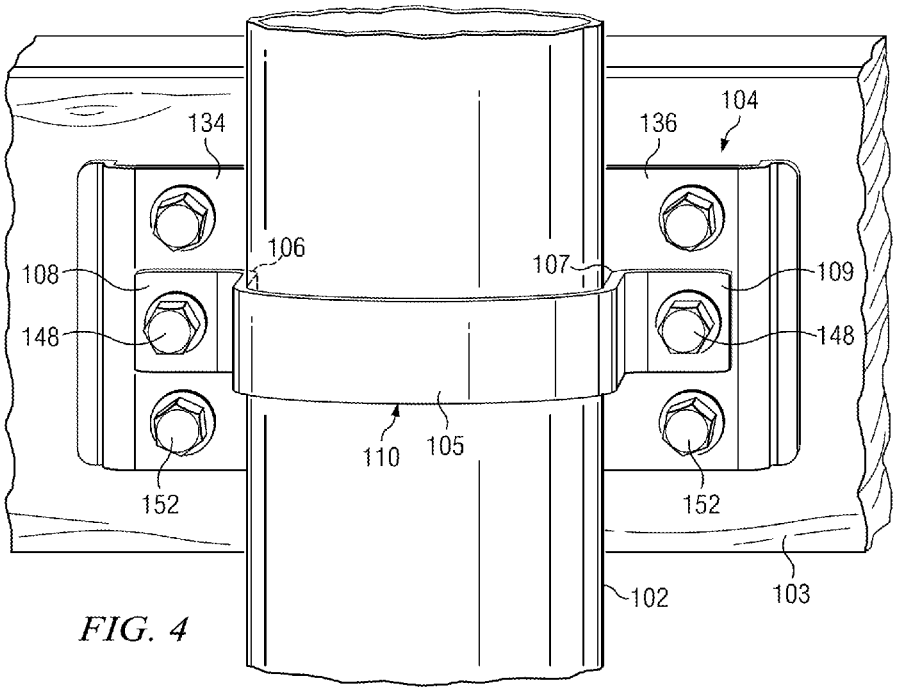
FIG. 4 illustrates a perspective view of a wood to pipe connection using the bracket of FIG. 3.

Reference is now made to FIGS. 3 and 4 which each illustrate a perspective view of an embodiment for a bracket and wood to pipe connection. The bracket is used in making a wood to pipe connection. The connection comprises: an elongated pipe (pole or post) member 102; a wood frame member 103 (such as a fence rail) disposed in close association to the elongated pipe member 102; and a bracket 104 for attaching the wood frame member 103 to the elongated pipe member 102.

Figure 5:
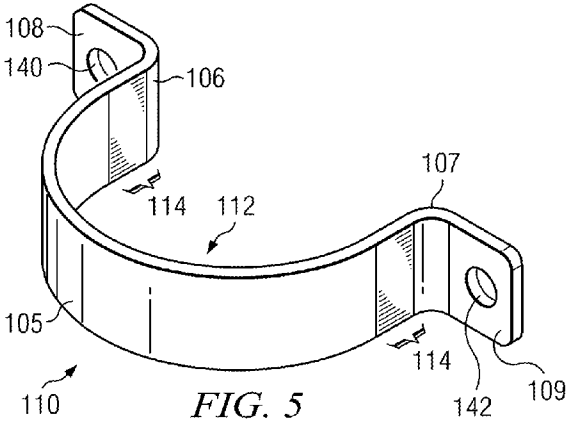
FIG. 5 is a perspective view of a front member of the bracket shown in FIG. 3.
Figure 6:
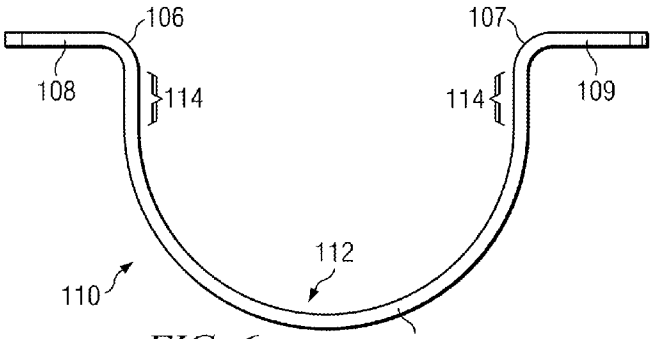
FIG. 6 is a side view of the front member of the bracket shown in FIG. 3.

The bracket 104 includes a front member 110 having a curvilinear portion 105 dimensioned for registering with and partially encircling the elongated pipe member 102. A perspective view of the front member 110 is shown in FIG. 5, and a side view of the front member 110 is shown in FIG. 6. The curvilinear portion 105 portion terminates at ends 106 and 107. Extending generally perpendicularly away from the ends 106 and 107 of the curvilinear portion 105 are first and second wing members 108 and 109, respectively. The curvilinear portion 105 has an inside radius set to be slightly larger than the radius of the elongated pipe member 102 (for example, a radius of 1.19 inches for a 2.0 inch diameter pipe). The depth of the curvilinear portion 105 is larger than said radius but smaller than the diameter of the elongated pipe member 102. The curvilinear portion 105 may mainly comprise an arcuate portion 112 with linear transition portions 114 between the ends of the arcuate portion and the ends 106 and 107 at the first and second wing members 108 and 109, respectively.

Figure 7:
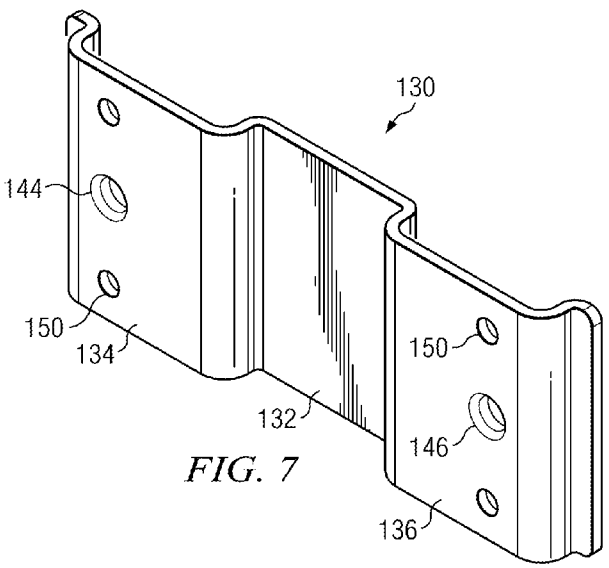
FIG. 7 is a perspective view of a back member of the bracket shown in FIG. 3.
Figure 8:
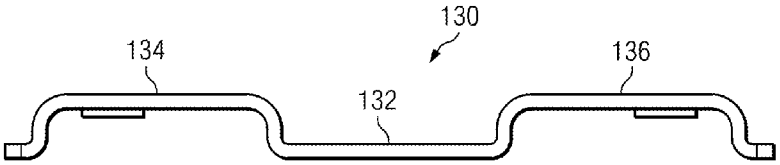
FIG. 8 is a side view of the back member of the bracket shown in FIG. 3.

The bracket 104 further includes a back member 130 having a central portion 132 flanked by first and second end portions 134 and 136, respectively. A perspective view of the back member 130 is shown in FIG. 7, and a side view of the back member 130 is shown in FIG. 8. The face of the central portion 132 is recessed with respect to the face of the first and second end portions 134 and 136. The recessed central portion 132 forms a seating area for receiving the elongated pipe member 102.

Figure 9:
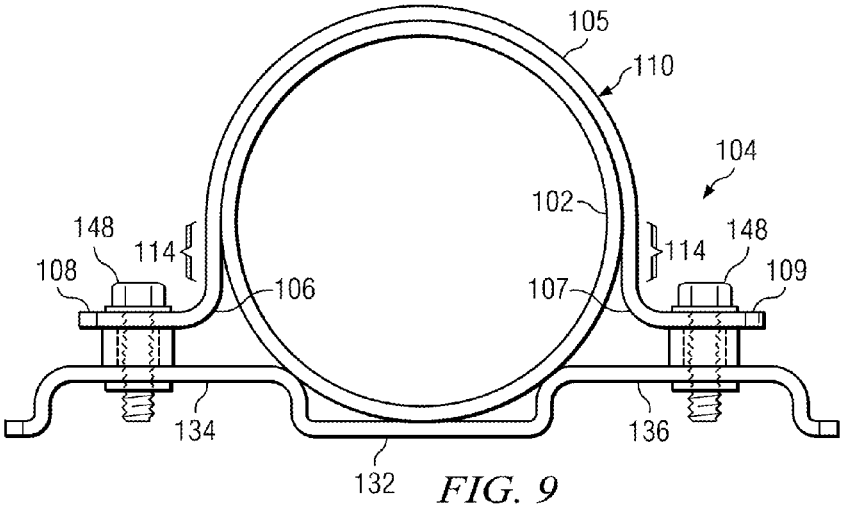
FIG. 9 illustrates a side view of an assembled bracket shown clamping an elongated pipe member.

Reference is now additionally made to FIG. 9 which illustrates a side view of the assembled bracket 104 (shown clamping the elongated pipe member 102). The first and second wing members 108 and 109 of the front member 110 include first and second fastener openings 140 and 142, respectively (see, FIG. 5). The first and second end portions 134 and 136 of the back member 130 include first and second fastener openings 144 and 146, respectively (see, FIG. 7). In a preferred embodiment, the first and second fastener openings 140 and 142 are sized to enable a fastening means 148 (e.g., a threaded screw or bolt) to pass therethrough while the first and second fastener openings 144 and 146 are sized and configured to engage threads of the fastening means 148. The elongated pipe member 102 passes between the front member 110 and the back member 130 and is seated in the recessed central portion 132. The fastening means 148 are tightened causing the elongated pipe member 102 to be compressed or clamped between the curvilinear portion 105 and the recessed central portion 132. In this way, the bracket 104 is frictionally coupled to the elongated pipe member 102. The width and depth of the recessed central portion 132 are specifically provided to conform to the size of elongated pipe member 102 and thus center the elongated pipe member 102 within the bracket 104 and in alignment with the curvilinear portion 105. A cylindrical spacer member through which each of the fasteners 148 pass may be provided between the back side of each of the first and second wing members 108 and 109 of the front member 110 and the front side of each of the first and second end portions 134 and 136 (see, FIGS. 9 and 10).

Reference is once again made to FIGS. 3-4 and 7-8. The first and second end portions 134 and 136 of the back member 130 further include additional fastener openings 150 (see, FIG. 7). In an embodiment, the additional fastener openings 150 are sized to enable a fastening means 152 (e.g., a threaded screw) to pass therethrough. Tightening of the fastening means 152 passing through the additional fastener openings 150 causes the bracket 104 to be attached to the wood frame member 103 (see, FIG. 4). In a preferred embodiment, the additional fastener openings 150 are sized and configured to engage threads of the fastening means 152. The recessed central portion 132 also produces a raised first and second end portions 134 and 136 of the back member 130 having an offset. This offset is provided, specifically in connection with the preferred embodiment with threaded additional fastener openings 150, to allow the fastening means 152 to be completely tightened without binding or interference in the threaded additional fastener openings 150 when attaching the bracket to the wood frame member 103 (see, FIG. 4).

The raised first and second end portions 134 and 136 of the back member 130 having an offset present an additional advantage. The raised first and second end portions 134 and 136 are located where the fastening means 152 engages the wood frame member 103 (see, FIG. 4). The presented offset allows water and moisture to escape to reduce the risk of wood rot at the bracket attachment area. This offset also provides a visual inspection area enabling the installer to see if the wood is compromised before failure.

Figure 10:
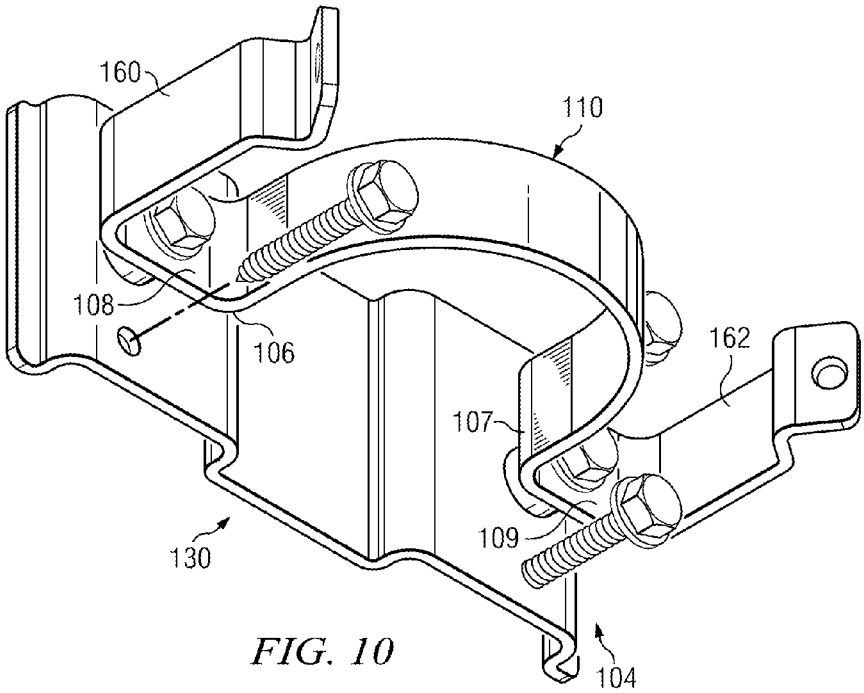
FIG. 10 illustrates a perspective view of an alternative embodiment for the bracket.

Reference is now made to FIG. 10 which illustrates a perspective view of an alternative embodiment for the bracket 104. The bracket 104 of FIG. 10 is similar to the bracket 104 of FIG. 3 in many ways. Like reference numbers refer to like or similar parts and further description of those like or similar parts is not provided.

Figure 11:
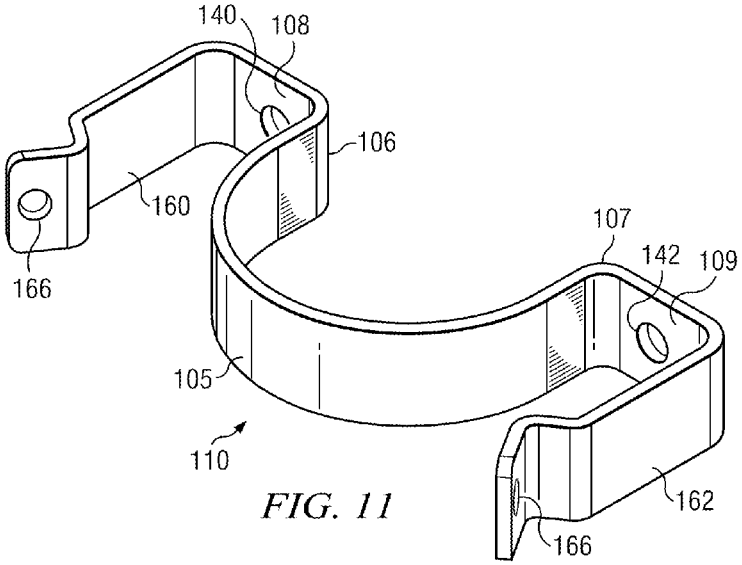
FIG. 11 is a perspective view of a front member of the bracket shown in FIG. 10.
Figure 12:
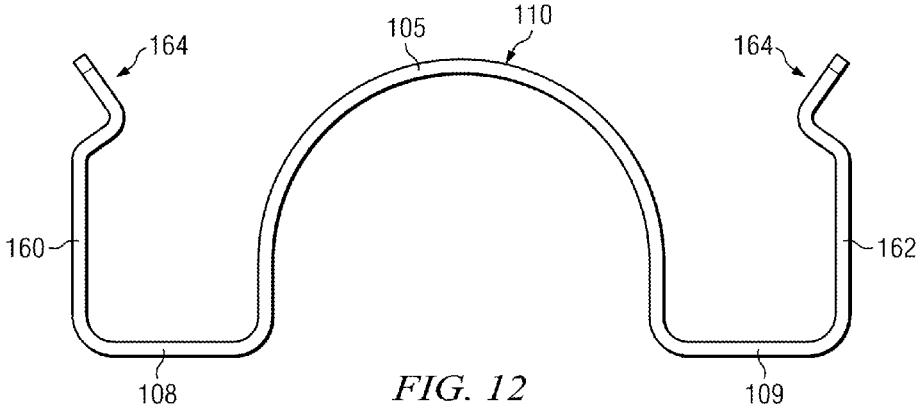
FIG. 12 is a side view of a front member of the bracket shown in FIG. 10.

The bracket 104 of FIG. 10 differs from the bracket 104 of FIG. 3 in the configuration of the front member 110. The front member 110 has the curvilinear portion 105 which terminates at ends 106 and 107, and first and second wing members 108 and 109 extend generally perpendicularly away from the ends 106 and 107, respectively. The front member 110 still further includes first and second upright members 160 and 162 which extend generally perpendicularly from the ends of the first and second wing members 108 and 109, respectively. The first and second upright members 160 and 162 extend in a direction away from the back member 130 (i.e., back towards the curvilinear portion 105). A perspective view of the alternative front member 110 is shown in FIG. 11, and a side view of the alternative front member 110 is shown in FIG. 12. Each of the first and second upright members 160 and 162 terminates in a Z bend 164. Attachment of the alternative front member 110 to the back member 130 is made in the same manner as described above to provide a clamping action for friction retention of the pipe.

Figure 13:
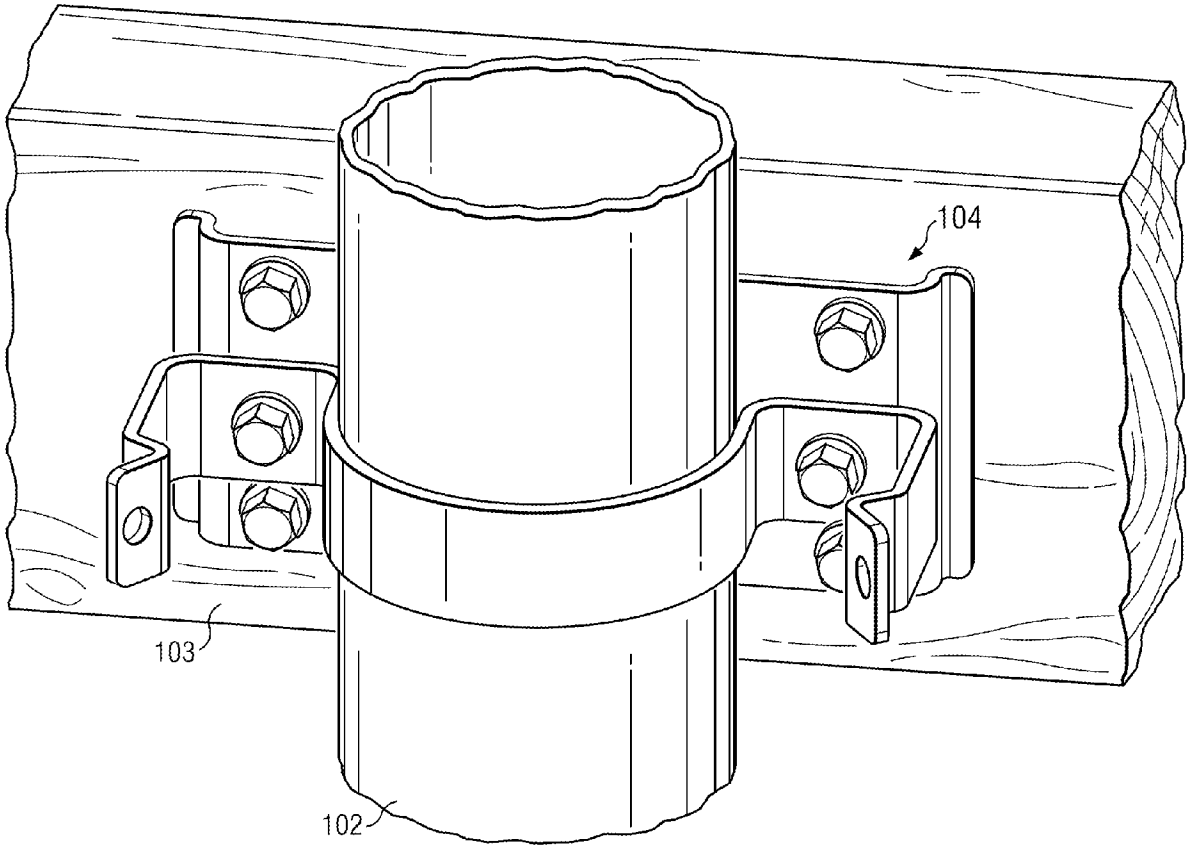
FIG. 13 illustrates a perspective view of a wood to pipe connection using the bracket of FIG. 10.
Figure 14:
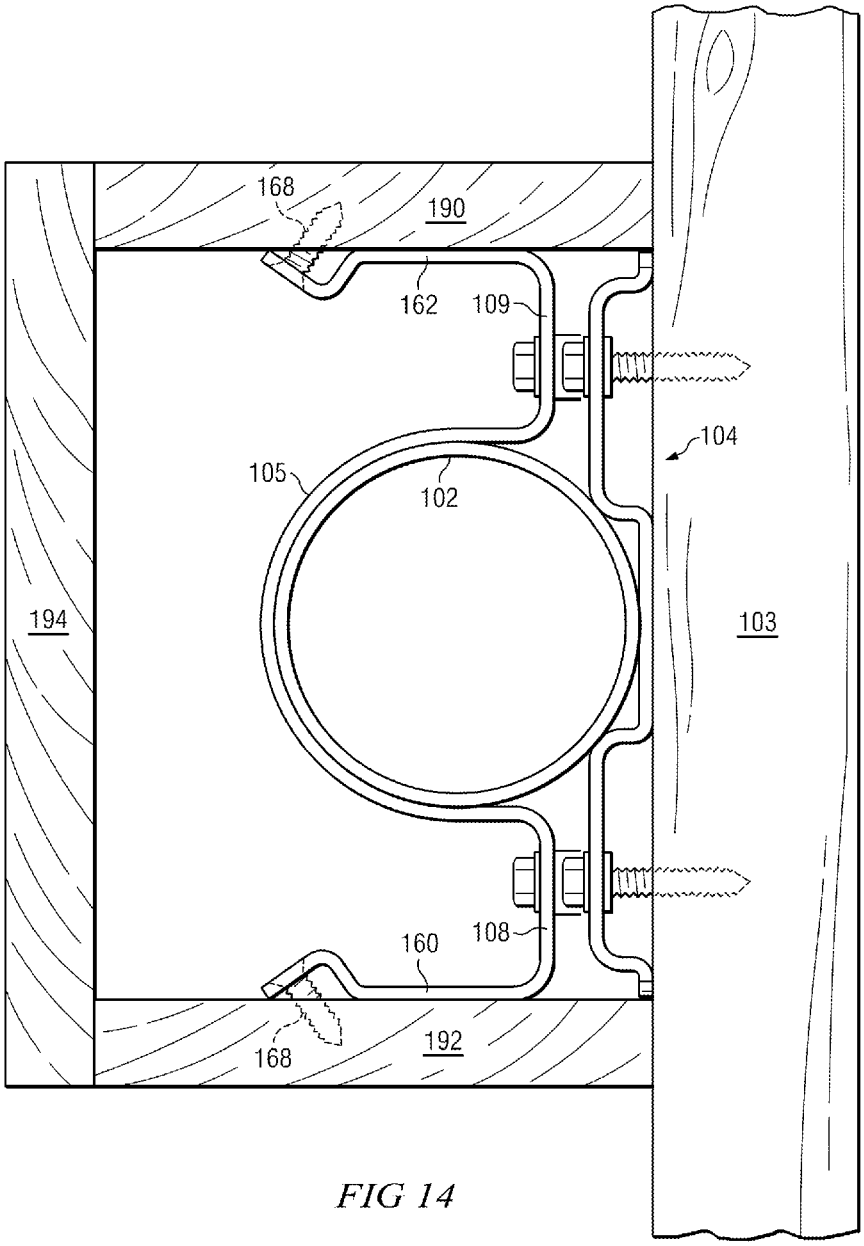
FIG. 14 illustrates an end view of the wood to pipe connection using the bracket of FIG. 10 where the pole has been boxed in and the bracket concealed.

The first and second upright members 160 and 162 with terminating Z bend 164 portions are provided to enable the bracket 104 to support an installation for boxing in the elongated pipe member 102 and concealing the bracket 104. FIG. 13 shows the bracket of FIG. 10 installed as a wood to pipe connector in a fencing application. There is no boxing of the pipe or concealment of the bracket in FIG. 13. FIG. 14 is a top view of the bracket of FIG. 10 installed as a wood to pipe connector in a fencing application with wooden board materials used to box in the pipe and conceal the bracket. Specifically, the boxing in of the pipe is accomplished using three wooden boards 190, 192 and 194. The boards 190 and 192 comprise side boards of the box. These boards 190 and 192 are oriented perpendicular to the wood frame member 103. With reference to FIG. 11, the Z bend 164 at the terminating end of each of the first and second upright members 160 and 162 includes a fastener opening 166. The fastener opening 166 is sized to enable a fastening means 168 (e.g., a threaded screw) to pass therethrough. Tightening of the fastening means 168 passing through the fastener opening 166 causes the boards 190 and 192 to be attached to the bracket 104. The boxing in of the elongated pipe member 102 and concealment of the bracket 104 as shown in FIG. 14 is then completed by attaching the board 194 to the ends of the boards 190 and 192 using an appropriate fastening means (e.g., a screw or nail).

Figure 15:
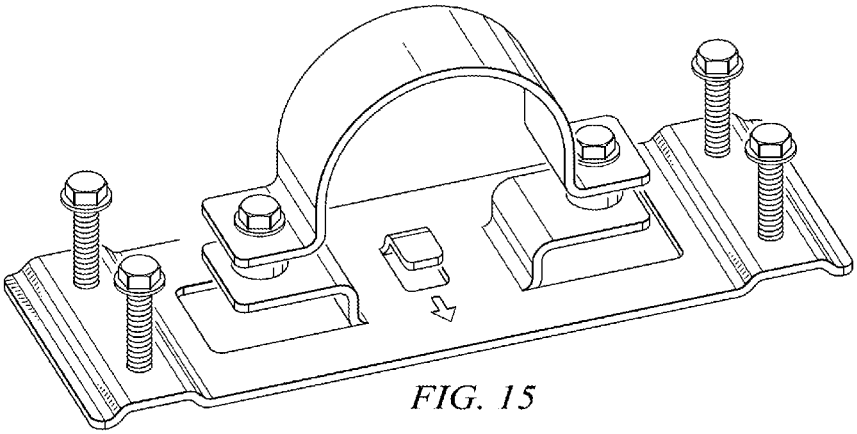
FIGS. 15 and 16 each illustrate a perspective view of an alternative embodiment for the bracket.
Figure 16:
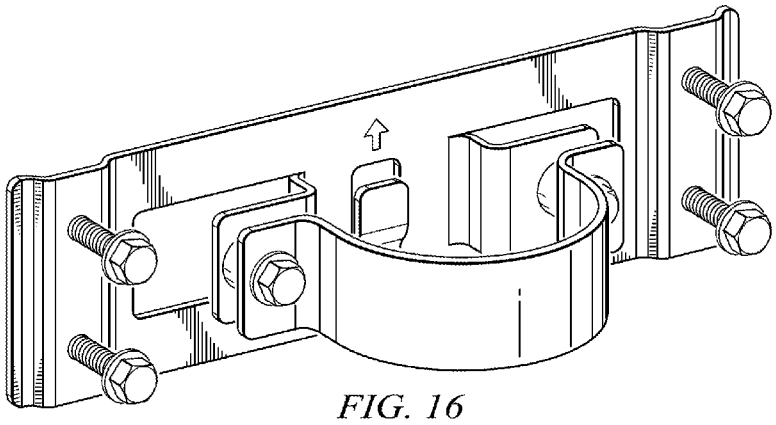

Reference is now made to FIGS. 15 and 16 which illustrate a perspective view of an alternative embodiment for the bracket 104. The bracket 104 of FIGS. 15 and 16 is similar to the bracket 104 of FIG. 3 in many ways. Like reference numbers refer to like or similar parts and further description of those like or similar parts is not provided.

It will be noted that the bracket 104 of FIGS. 15 and 16 uses a same or similar front member 110.

Figure 17:
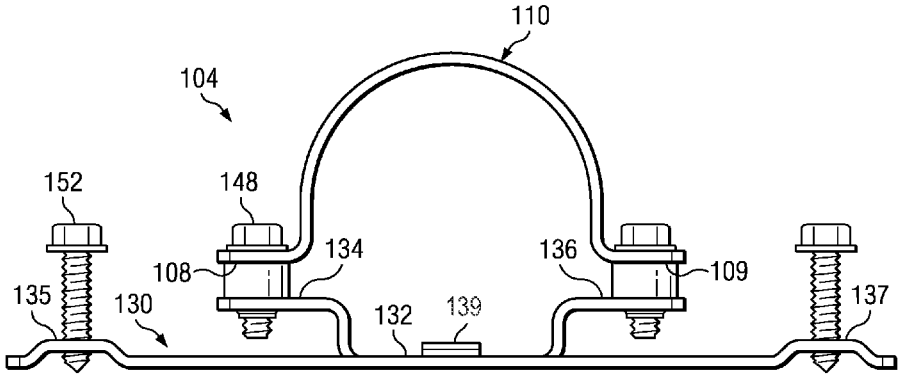
FIG. 17 illustrates a side view of an assembled bracket shown in FIGS. 15 and 16.
Figure 18:
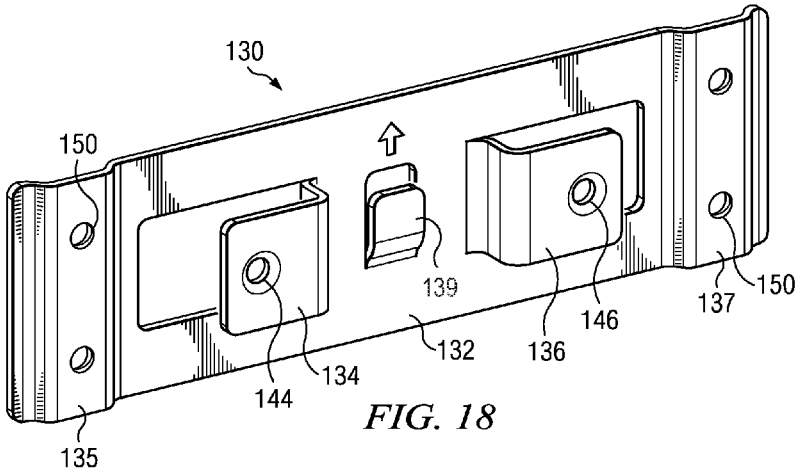
FIG. 18 is a perspective view of a back member of the bracket shown in FIGS. 15 and 16.

The bracket 104 of FIGS. 15 and 16 has a different configuration for the back member 130. The back member 130 has a central portion 132 flanked by first and second end portions 134 and 136, respectively, and third and fourth end portions 135 and 137, respectively. A perspective view of the back member 130 is shown in FIG. 18, and a side view of the back member 130 is shown in FIG. 17. The face of the central portion 132 is recessed with respect to the face of the first and second end portions 134 and 136, and includes a raised tab 139. The recessed central portion 132 forms a seating area for receiving the elongated pipe member 102, and the tab is compressible when the pipe is received and secured by the bracket using the clamping action and friction retention described above.

Reference is now additionally made to FIG. 17 which illustrates a side view of the assembled bracket 104. The first and second wing members 108 and 109 of the front member 110 include first and second fastener openings 140 and 142, respectively (see, FIG. 5). The first and second end portions 134 and 136 of the back member 130 include first and second fastener openings 144 and 146, respectively (see, FIG. 18). In a preferred embodiment, the first and second fastener openings 140 and 142 are sized to enable a fastening means 148 (e.g., a threaded screw or bolt) to pass therethrough while the first and second fastener openings 144 and 146 are sized and configured to engage threads of the fastening means 148. The elongated pipe member (not shown) passes between the front member 110 and the back member 130 and is seated in the recessed central portion 132. The fastening means 148 are tightened causing the elongated pipe member 102 to be compressed or clamped between the curvilinear portion 105 and the recessed central portion 132 (at the tab 139). In this way, the bracket 104 is frictionally coupled to the elongated pipe member 102. The width and depth of the recessed central portion 132 taking into account the tab 139 are specifically provided to conform to the size of elongated pipe member 102 and thus center the elongated pipe member 102 within the bracket 104 and in alignment with the curvilinear portion 105. The first and second end portions 134 and 136 of the back member 130 present an offset. This offset is provided not only to support centering of the received pipe but also to enable the installer to view the fastening. A cylindrical spacer member through which each of the fasteners 148 pass may be provided between the back side of each of the first and second wing members 108 and 109 of the front member 110 and the front side of each of the first and second end portions 134 and 136 (see, FIG. 17).

The third and fourth end portions 135 and 137 of the back member 130 include additional fastener openings 150 (see, FIG. 18). In an embodiment, the additional fastener openings 150 are sized to enable a fastening means 152 (e.g., a threaded screw) to pass therethrough. Tightening of the fastening means 152 passing through the additional fastener openings 150 causes the bracket 104 to be attached to the wood frame member 103. In a preferred embodiment, the additional fastener openings 150 are sized and configured to engage threads of the fastening means 152. The third and fourth end portions 135 and 137 of the back member 130 present an offset. This offset is provided, specifically in connection with the preferred embodiment with threaded additional fastener openings 150, to allow the fastening means 152 to be completely tightened without binding or interference in the threaded additional fastener openings 150 when attaching the bracket to the wood frame member 103. The offset is further provided to allow water and moisture to escape to reduce the risk of wood rot at the bracket attachment area. This offset also provides a visual inspection area enabling the installer to see if the wood is compromised before failure.

With respect to all disclosed embodiments, the front member 110 and back member 130 are preferably made from sheet metal (more preferably galvanized metal). The sheet metal is formed into the shapes of the front member 110 and back member 130 as shown using a stamping process. This stamping process further forms the included openings, recesses and offsets.

With respect to all disclosed embodiments, the elongated pipe member 102 could be a metal conduit, standard pipe member or even a solid circular wood pole member. The wood to pipe bracket disclosed herein is especially useful in attaching wood fencing or sign material to metal pipe.

With respect to all disclosed embodiments, the bracket is preferably sold in a partially assembled state with all hardware in position and partially tightened. Thus, the openings in the bottom member 130, as described in the preferred embodiments, are threaded openings. The advantage of a partially assembled product is that the product may be easily installed by a single worker who need not have to keep up with the fastening means. The attachment hardware fits securely in the bracket to prevent it from falling out prior to final installation. The pre-installed hardware makes installation of the wood to pipe bracket faster and easier. This design feature also eliminates the need to have a separate hardware pack that could be dropped and/or forgotten. Furthermore, the pre-installed hardware provides a method for single man installation of the bracket and assurance that the installer is using the correct size and grade of hardware.

In the embodiments of FIGS. 3-12, the width of the wood to pipe bracket is such that standard 1×4 and 1×6 fence pickets can be used to conceal the bracket. Other brackets are too wide to conceal the post and bracket with a single piece of standard sized wood (this is a potential disadvantage of the embodiment of FIGS. 15-18).

The low profile design of all embodiments disclosed herein provides for lower manufacturing costs and smaller pack size for shipping and storage.

Although the wood to pipe bracket is preferably made of galvanized sheet metal, it will be understood that the bracket could instead be made of plastic or stainless steel for other applications.

The embodiment of the bracket shown in FIGS. 10-14 supports a full wrap band to provide a secure and easy way for the user to conceal the elongated steel member and the bracket with wood or other suitable material. Wrapping steel posts in connection with prior art bracket designs requires special carpentry skills and is considered difficult by most users. The full wrap strap makes the task of wrapping the pipe member much more secure and easier.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A bracket, comprising:

a sheet metal front member shaped to include a curvilinear portion flanked by first and second wing portions;

a sheet metal back member comprising a flat central portion and first and second end portions being cut out from the sheet metal at the flat central portion with an upward bend to extend above a surface of the flat central portion;

fasteners adapted to secure the first and second wing portions of the front member to the first and second end portions, respectively, of the back member in a manner which forms a clamping area between the curvilinear portion and the flat central portion; and wherein the back member further comprises third and fourth end portions flanking the central portion, wherein the third and fourth end portions are offset with respect to the central portion.

2. The bracket of claim 1, wherein the clamping area is operable to frictionally attach the bracket to a received pipe/pole member.

3. The bracket of claim 1, wherein the back member further includes threaded openings, the bracket further comprising additional fasteners installed in the threaded openings, said additional fasteners configured to attach the bracket to a structural member.

4. The bracket of claim 1, wherein the offset of the third and fourth end portions with respect to the central portion provides an open space between a back surface of the third and fourth portions and a surface of a wood frame member to which the bracket is attached.

5. The bracket of claim 4, wherein the third and fourth end portions include threaded openings, the bracket further comprising additional fasteners installed in the threaded openings, said additional fasteners configured to attach the bracket to the wood frame member.

6. A bracket, comprising:

a front member formed of sheet metal and shaped to include a curvilinear portion flanked by first and second wing portions;

a back member formed of sheet metal and comprising first and second end portions spaced from each other that are cut out from the sheet metal at a central region of the back member with an upward bend to be raised above the central region of the back member to define edges of a pipe/pole seating area;

fasteners adapted to secure the first and second wing portions of the front member to the first and second end portions, respectively, of the back member in a manner which forms a pole clamp between the curvilinear portion of the front member and the central region of the back member between the raised first and second end portions; and wherein the back member further comprises third and fourth end portions laterally flanking the central region, wherein the third and fourth end portions are vertically offset from the central region.

7. The bracket of claim 6, wherein the clamping area is operable to frictionally attach the bracket to a received pipe/pole member.

8. The bracket of claim 6, wherein the back member further includes threaded openings, the bracket further comprising additional fasteners installed in the threaded openings, said additional fasteners configured to attach the bracket to a structural member.

9. The bracket of claim 6, wherein the vertical offset of the third and fourth end portions provides an open space between a back surface of the third and fourth end portions and a surface of a wood frame member when the bracket is coupled to the wood frame member.

10. The bracket of claim 9, wherein the third and fourth end portions include threaded openings, the bracket further comprising additional fasteners installed in the threaded openings, said additional fasteners configured to attach the bracket to the wood frame member.

11. A bracket, comprising:

a front member made of sheet material formed to include a curvilinear portion flanked by first and second wing portions on opposite ends of the curvilinear portion;

a back member made of sheet material comprising a flat central portion with cuts extending through the flat central portion to define first and second cutout portions of the sheet material at the flat central portion extending in opposite directions and with each cutout portion having a proximal end coupled at an upward bend to the flat central portion and a distal end separated from and raised above a surface of the flat central portion to form a pipe seating area;

fasteners adapted to secure the first and second wing portions of the front member to the first and second cutout portions, respectively, of the back member in a manner suitable for clamping a pipe positioned within the pipe seating area between the curvilinear portion of the front member and the central portion of the back member; and wherein the back member further comprises third and fourth end portions, wherein the first and second cutout portions are positioned between the third and fourth end portions, wherein the third and fourth end portions protrude above the surface of the central portion to provide an open space between a back surface of the third and fourth end portions and a planar wood frame to which the bracket is coupled.

12. The bracket of claim 11, wherein the back member further comprises an additional cut extending through the flat central portion to define a tab cutout portion in the location of the pipe seating area between the first and second end portions, the tab cutout portion having a proximal end coupled to the flat central portion and a distal end separated and raised above the surface of the flat central portion.

* * * * *